US007662438B2

(12) United States Patent
Brisberger et al.

(10) Patent No.: US 7,662,438 B2
(45) Date of Patent: Feb. 16, 2010

(54) METHOD AND DEVICE FOR HOT-DIP COATING A METAL STRAND

(75) Inventors: Rolf Brisberger, Issum (DE); Bernhard Tenckhoff, Duisburg (DE); Holger Behrens, Erkrath (DE); Bodo Falkenhahn, Ratingen (DE); Walter Trakowski, Duisburg (DE); Michael Zielenbach, Siegen (DE); Robert Jürgens, Remscheid (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 622 days.

(21) Appl. No.: 10/536,872

(22) PCT Filed: Nov. 15, 2003

(86) PCT No.: PCT/EP03/12792

§ 371 (c)(1),
(2), (4) Date: Feb. 21, 2006

(87) PCT Pub. No.: WO2004/050940

PCT Pub. Date: Jun. 17, 2004

(65) Prior Publication Data

US 2006/0141166 A1 Jun. 29, 2006

(30) Foreign Application Priority Data

Nov. 30, 2002 (DE) ..... 102 55 994

(51) Int. Cl.
*B05D 1/18* (2006.01)

(52) U.S. Cl. ..... 427/431; 427/433; 427/435; 427/436; 118/419; 118/672; 118/674

(58) Field of Classification Search ..... 427/431, 427/433, 435, 436; 118/419, 672, 674
See application file for complete search history.

(56) References Cited

U.S. PATENT DOCUMENTS 5,665,437 A * 9/1997 Frommann et al. ..... 427/591

FOREIGN PATENT DOCUMENTS

CA 2 131 059 3/1995

(Continued)

OTHER PUBLICATIONS

Patent Abstracts of Japan, BD. 2000, No. 5, Sep. 14, 2000 & JP 2000 053295 A (NKK Corp), Feb. 22, 2000.

(Continued)

*Primary Examiner*—Binh X Tran
(74) *Attorney, Agent, or Firm*—Friedrich Kueffner

(57) ABSTRACT

The invention relates to a method for hot-dip coating a metal strand (1), especially a steel strip, according to which the metal strand (1) is vertically guided through a container (3) accommodating the molten coating metal (2) and through a guide channel (4) disposed upstream thereof. An electromagnetic field is generated in the area of the guide channel (4) by means of at least two inductors (5) disposed at both sides of the metal strand (1) to retain the coating material (2) in the container (3). In order to stabilize the metal strand (1) in a center position in the guide channel (4), an electromagnetic field, superimposing the electromagnetic field of the inductors (5), is generated by means of at least two additional coils (6) disposed at both sides of the metal strand (1). In order to improve efficiency of the control of the metal strand in the guide channel, the center position of the metal strand (1) in the guide channel (4) is stabilized in a closed control loop by carrying out the following steps: a) detecting the position (s, s', s") of the metal strand (1) in the guide channel (4); b) measuring the induced current ($I_{Ind}$) in the inductors (5); c) measuring the induced current ($I_{Corr}$) in the additional coils (6); d) influencing the induced current ($I_{Corr}$) in the additional coils (6) depending on the parameters (s, $I_{Ind}$, $I_{Corr}$) measured in steps a) to c), in order to maintain the metal strand (1) in a center position in the guide channel (4). The invention further relates to a device for hot-dip coating a metal strand.

6 Claims, 1 Drawing Sheet

FOREIGN PATENT DOCUMENTS

| | | | |
|---|---|---|---|
| DE | 195 35 854 | | 3/1997 |
| DE | 100 14 867 | | 9/2001 |
| EP | 0 673 444 | | 12/1996 |
| EP | 0 855 450 | | 7/1998 |
| JP | 10046310 A | * | 2/1998 |
| WO | 96/03533 | | 2/1996 |
| WO | 02/14572 | | 2/2002 |

OTHER PUBLICATIONS

Patent Abstracts of Japan, BD. 1998, No. 6, Apr. 30, 1998 & JP 10 046310 A (Nisshin Steel Co Ltd), Feb. 17, 1998.

Patent Abstracts of Japan, BD. 0174, No. 6, Jul. 29, 1993 & JP 5 07880 A (NKK Corp), Mar. 30, 1993.

Patent Abstracts of Japan, BD. 1999, No. 2, Feb. 26, 1999 & JP 10 298727 A (NKK Corp), Nov. 10, 1998.

Patent Abstracts of Japan, BD. 0132, No. 93, Jul. 6, 1989 & JP 1 087754 A (Kawasaki Steel Corp), Mar. 31, 1989.

Patent Abstracts of Japan & JP 5 086 446 (Nippon Konan KK), Apr. 6, 1993.

* cited by examiner

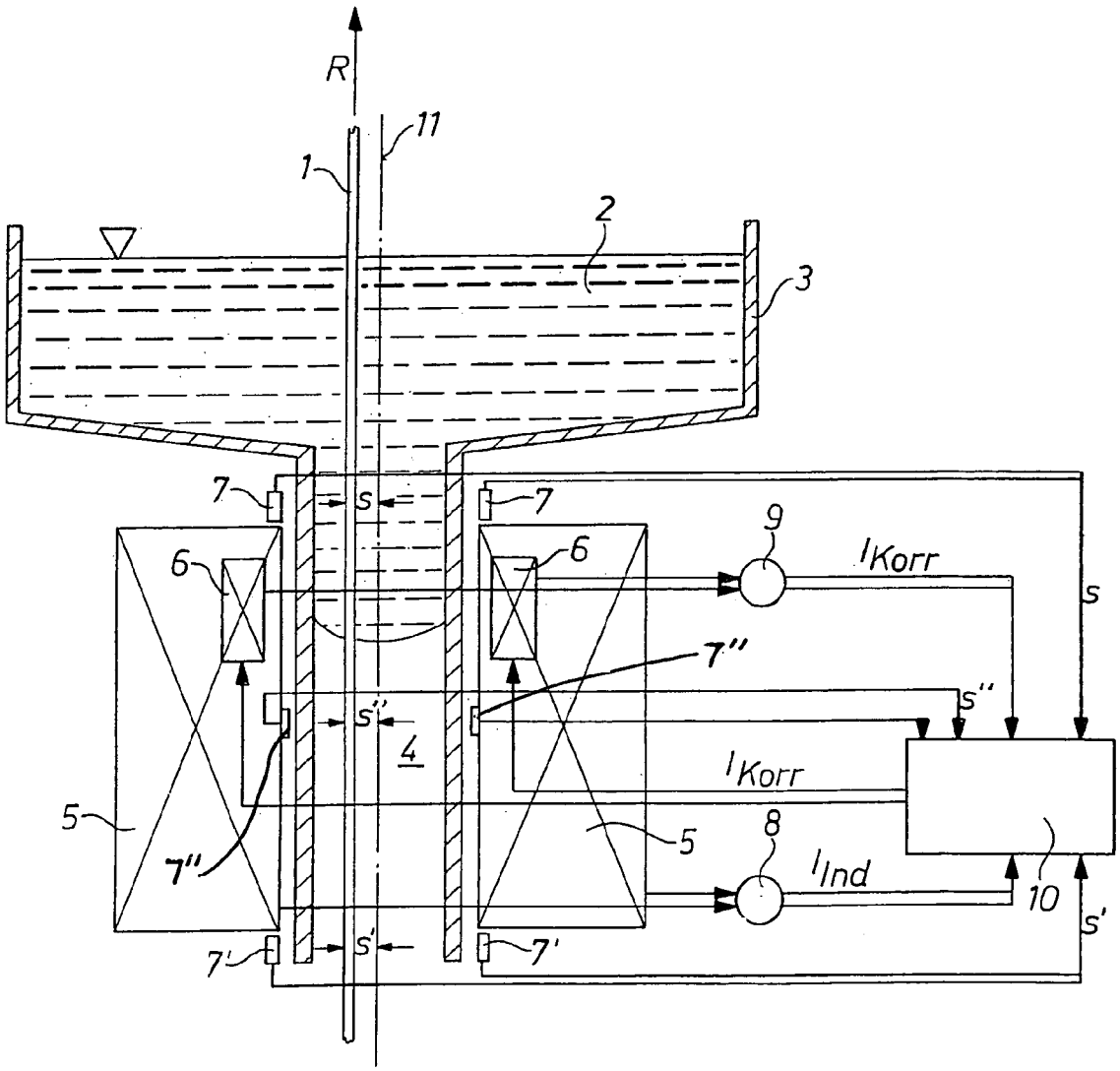
R
11
1
2
3
7
s
7
9
6
6
$I_{Korr}$
s
7''
s''
s''
4
$I_{Korr}$
5
5
8
7''
$I_{Ind}$
10
s'
7'
s'
7'

METHOD AND DEVICE FOR HOT-DIP COATING A METAL STRAND

The invention concerns a method for hot dip coating a metal strand, especially a steel strip, in which the metal strand is passed vertically through a coating tank that contains the molten coating metal and through a guide channel upstream of the coating tank, wherein an electromagnetic field is generated in the area of the guide channel by means of at least two inductors installed on both sides of the metal strand in order to keep the coating metal in the coating tank, and wherein an electromagnetic field superposed on the electromagnetic field of the inductors is generated by means of at least two supplementary coils installed on both sides of the metal strand in order to stabilize the metal strand in a central position in the guide channel. The invention also concerns a device for hot dip coating a metal strand.

Conventional metal hot dip coating installations for metal strip have a high-maintenance part, namely, the coating tank and the fittings it contains. Before being coated, the surfaces of the metal strip must be cleaned of oxide residues and activated for bonding with the coating metal. For this reason, the strip surfaces are subjected to heat treatments in a reducing atmosphere before the coating operation is carried out. Since the oxide coatings are first removed by chemical or abrasive methods, the reducing heat treatment process activates the surfaces, so that after the heat treatment, they are present in a pure metallic state.

However, this activation of the strip surfaces increases their affinity for the surrounding atmospheric oxygen. To prevent the surface of the strip from being reexposed to atmospheric oxygen before the coating process, the strip is introduced into the hot dip coating bath from above in an immersion snout. Since the coating metal is present in the molten state, and since one would like to utilize gravity together with blowing devices to adjust the coating thickness, but the subsequent processes prohibit strip contact until the coating metal has completely solidified, the strip must be deflected in the vertical direction in the coating tank. This is accomplished with a roller that runs in the molten metal. This roller is subject to strong wear by the molten coating metal and is the cause of shutdowns and thus loss of production.

The desired low coating thicknesses of the coating metal, which vary in the micrometer range, place high demands on the quality of the strip surface. This means that the surfaces of the strip-guiding rollers must also be of high quality. Problems with these surfaces generally lead to defects in the surface of the strip. This is a further cause of frequent plant shutdowns.

To avoid the problems associated with rollers running in the molten coating metal, approaches have been proposed, in which a coating tank is used that is open at the bottom and has a guide channel in its lower section for guiding the strip vertically upward, and in which an electromagnetic seal is used to seal the open bottom of the coating tank. The production of the electromagnetic seal involves the use of electromagnetic inductors, which operate with electromagnetic alternating or traveling fields that seal the coating tank at the bottom by means of a repelling, pumping or constricting effect.

A solution of this type is described, for example, in EP 0 673 444 B1. The solution described in WO 96/03,533 and the solution described in JP 50[1975]-86,446 also provide for an electromagnetic seal for sealing the coating tank at the bottom.

Although this allows the coating of nonferromagnetic metal strip, problems arise in the coating of steel strip, which is essentially ferromagnetic, because the ferromagnetism causes the strip to be drawn to the walls of the channel in the electromagnetic seals, and this damages the surface of the strip. Another problem that arises is that the coating metal and the metal strip itself are unacceptably heated by the inductive fields.

An unstable equilibrium exists with respect to the position of the ferromagnetic steel strip passing through the guide channel between two traveling-field inductors. The sum of the forces of magnetic attraction acting on the strip is zero only in the center of the guide channel. As soon as the steel strip is deflected from its center position, it draws closer to one of the two inductors and moves farther away from the other inductor. The reasons for this type of deflection may be simple flatness defects of the strip. Defects of this type include any type of strip waviness in the direction of strip flow, viewed over the width of the strip (center buckles, quarter buckles, edge waviness, flutter, twist, crossbow, S-shape, etc.). The magnetic induction, which is responsible for the magnetic attraction, decreases in field strength with increasing distance from the inductor according to an exponential function. Therefore, the force of attraction similarly decreases with the square of the induction field strength with increasing distance from the inductor. This means that when the strip is deflected in one direction, the force of attraction to one inductor increases exponentially, while the restoring force by the other inductor decreases exponentially. Both effects intensify by themselves, so that the equilibrium is unstable.

DE 195 35 854 A1 and DE 100 14 867 A1 offer approaches to the solution of this problem, i.e., the problem of more precise position control of the metal strand in the guide channel. According to the concepts disclosed there, the coils for inducing the electromagnetic traveling field are supplemented by additional coils, which are connected to an automatic control system and see to it that when the metal strip deviates from its center position, it is brought back into this position.

In these previous approaches to the problem, it was found to be a disadvantage that the efficiency of the automatic control system is not sufficient to ensure stable guidance of the metal strand in the center of the guide channel. In this connection, the large unsupported length between the lower guide roller below the guide channel and the upper guide roller above the coating bath can be a problem, since this unsupported length can be well over 20 m in a production plant. This increases the necessity for efficient automatic position control of the metal strip in the guide channel.

Therefore, the objective of the invention is to develop a method and a corresponding device for hot dip coating a metal strand, which make it possible to overcome the specified disadvantages. The goal is thus to improve the efficiency of the automatic control, so that it is possible in a simpler way to keep the metal strand in the center of the guide channel.

The objective of the invention with respect to the method is achieved by stabilizing the center position of the metal strand in the guide channel by the following sequence of steps in a closed-loop control system:

(a) measuring the position of the metal strand in the guide channel;

(b) measuring the induced current in the inductors;

(c) measuring the induced current in the supplementary coils; and (d) influencing the induced current in the supplementary coils as a function of all of the parameters measured in steps (a) to (c) to keep the metal strand in a central position in the guide channel.

The concept of the invention is thus aimed at measuring the three quantities: position of the metal strand in the guide channel, induced current in the inductors, and induced current in the supplementary coils, and using them for the closed-loop control of the position of the metal strand; the manipulated variable of the closed-loop control system is then the induced current in the supplementary coils.

With this procedure, it is possible for the automatic control to be based on both the magnetic field generated by the inductors (main coils) themselves and the superposed magnetic field generated by the supplementary coils, so that the overall result is an improvement in the efficiency of the automatic control system.

In a first modification, the electromagnetic field generated for sealing the coating tank is a polyphase traveling field generated by applying an alternating current with a frequency of 2 Hz to 2 kHz. Alternatively, a single-phase alternating field can be generated by applying an alternating current with a frequency of 2 kHz to 10 kHz.

It is especially preferred for the position of the metal strand in the guide channel to be determined inductively.

To ensure the most exact possible detection of the position of the strip, one modification provides that the position be determined in an area of the guide channel in which there is no effect or only an attenuated effect of the magnetic field of the inductors and/or of the magnetic field of the supplementary coils. Alternatively, however, it is also possible to make this determination in an area of the guide channel in which an effect of these magnetic fields does exist.

The measuring devices (the measuring coils) for determining the position of the metal strand are thus located inside or outside the area of the electromagnetic elements, which include both the inductor and the supplementary coils.

In particular, it is possible for the measuring devices to be arranged in the area of the extent of the inductor in front of the supplementary coil, for the measuring devices to be arranged in the area of the extent of the inductor next to the supplementary coil, or for the measuring devices to be arranged outside the area of the extent of the inductor. Combinations of these arrangements are also possible.

The device of the invention for hot dip coating a metal strand, which has at least two inductors installed on both sides of the metal strand in the area of the guide channel for generating an electromagnetic field in order to keep the coating metal in the coating tank and at least two supplementary coils installed on both sides of the metal strand for generating an electromagnetic field superposed on the electromagnetic field of the inductors in order to stabilize the metal strand in a central position in the guide channel, is characterized by measuring devices for measuring the position of the metal strand in the guide channel, the induced current in the inductors, and the induced current in the supplementary coils and by automatic control devices that are suitable for controlling the induced current in the supplementary coils as a function of the measured parameters in order to keep the metal strand in a central position in the guide channel.

It is advantageous for the measuring device for determining the position of the metal strand in the guide channel to be an inductive pickup.

In addition, the measuring devices for determining the position of the metal strand in the guide channel can be installed within the extent of the inductors, as viewed in the direction of conveyance of the metal strand. However, it is equally possible to install the measuring devices outside the extent of the inductors. In both cases, it is possible for the measuring devices for determining the position of the metal strand in the guide channel to be installed outside the extent of the supplementary coils, as viewed in the direction of conveyance of the metal strand. Exact determination of the position of the metal strand is ensured in this way.

Finally, in another modification, several measuring devices for determining the position of the metal strand in the guide channel can be installed in various places relative to the direction of conveyance of the metal strand. In this regard, the individual measuring devices can be installed both inside and outside the magnetic fields of the inductor and supplementary coil.

One embodiment of the invention is illustrated in the sole drawing, which shows a schematic representation of a hot dip coating device with a metal strand being guided through it.

The hot dip coating device has a coating tank 3, which is filled with molten coating metal 2. The molten coating metal can be, for example, zinc or aluminum. The metal strand 1 to be coated is in the form of a steel strip. It passes vertically upward through the coating tank 3 in conveying direction R. It should be noted at this point that it is also basically possible for the metal strand 1 to pass through the coating tank 3 from top to bottom. To allow passage of the metal strand 1 through the coating tank 3, the latter is open at the bottom, where a guide channel 4 is located. The guide channel 4 is drawn exaggeratedly large or broad.

BRIEF DESCRIPTION OF THE DRAWING

FIG. 1 is a schematic view, partially in section, of the device for hot-dip coating of a metal strand according to the present invention.

To prevent the molten coating metal 2 from flowing out at the bottom through the guide channel 4, two electromagnetic inductors 5 are located on either side of the metal strand 1. The electromagnetic inductors 5 generate a magnetic field, which produces lifting forces in the liquid coating metal 2, and these forces counteract the weight of the coating metal 2 and thus seal the guide channel 4 at the bottom.

The inductors 5 are two alternating-field or traveling-field inductors installed opposite each other. They are operated in a frequency range of 2 Hz to 10 kHz and create an electromagnetic transverse field perpendicular to the conveying direction R. The preferred frequency range for single-phase systems (alternating-field inductors) is 2 kHz to 10 kHz, and the preferred frequency range for polyphase systems (e.g., traveling-field inductors) is 2 Hz to 2 kHz.

The goal is to hold the metal strand 1, which is located in the guide channel 4, in such a way that it lies in a position that is as well defined as possible, preferably in the center plane 11 of the guide channel 4.

The metal strand 1 between the two opposing inductors 5 is generally drawn towards the closer inductor when an electromagnetic field is created between the inductors 5, and the attraction increases the closer the metal strand 1 approaches the inductor, which leads to an extremely unstable strip center position. During the operation of the installation, this results in the problem that the metal strand 1 cannot run freely and centrally through the guide channel 4 between the activated inductors 5 due to the force of attraction of the inductors.

Therefore, to stabilize the metal strand 1 in the center plane 11 of the guide channel 4, supplementary coils 6 are installed on both sides of the guide channel 4 or metal strand 1. These supplementary coils 6 are controlled by an automatic control device 10 in such a way that the superposition of the magnetic fields of the inductors 5 and the supplementary coils 6 always keeps the metal strand 1 centered in the guide channel 4.

The magnetic field of the inductors 5 can thus be strengthened or weakened by the supplementary coils 6, depending on the control system (superposition principle) without violating the sealing condition (minimum necessary field strength for the sealing). In this way, the position of the metal strand 1 in the guide channel 4 can be influenced.

To this end, the automatic control device 10 is first supplied with a signal s, s', or s", which gives the position of the metal strand 1 in the guide channel 4. The positions s, s', and s" are determined by position measuring devices 7, 7', and 7", respectively, which are inductive displacement pickups. The position of the metal strand 1 between the inductors 5 in the electromagnetic field is thus determined inductively, utilizing the feedback effect of the metal strand 1 in the magnetic field.

In addition, the automatic control devices 10 are supplied with the induced current in the inductors 5 (current $I_{Ind}$) and the induced current in the supplementary coils 6 (current $I_{Korr}$), which are determined by current measuring devices 8 and 9, respectively.

The automatic control device 10 contains stored algorithms, which supply a new adjusting signal in the form of an induced current $I_{Korr}$ to the supplementary coils 6 on the basis of the three input parameters: the positions s, s', and s" of the metal strand 1 in the guide channel, the induced current $I_{Ind}$ in the inductors 5, and the induced current $I_{Korr}$ in the supplementary coils 6. In this way, the position of the metal strand 1 is held in the closed-loop control system in such a way that the deviations of the position of the metal strand 1 from the center plane 11 are minimized, i.e., the values s, s', and s" are kept at zero, if at all possible.

As is apparent, the positions s, s', and s" of the metal strand 1 in the guide channel 4 are determined by the position measuring devices 7, 7', and 7", respectively. As viewed in the direction of conveyance R, position measuring device 7 is positioned above the inductors 5, position measuring device 7' is positioned below the inductors 5, and position measuring device 7" is positioned in the area of the inductors 5. In the present case, all three position measuring devices 7, 7', and 7" are arranged outside the area of the supplementary coils 6. The mean value of the values measured by the position measuring devices 7, 7', 7" can be determined in the control device 10.

Since the position measuring devices 7, 7', and 7" are inductive pickups, the effect of the magnetic fields generated by the inductors 5 and the supplementary coils 6 should remain as small as possible. This is ensured by the arrangement of the position measuring devices 7 and 7' outside the extent of the inductors 5. However, as the drawing shows, one of the position measuring devices (7" in the present case) can be positioned in the area of the inductors 5.

Accordingly, even though it has been found to be effective to arrange the position measuring devices 7 and 7' outside the range of action of the supplementary coils 6, in principle, they can also be arranged within the range of action of the inductors 5 and the supplementary coils 6.

LIST OF REFERENCE SYMBOLS

1 metal strand (steel strip)
2 coating metal
3 coating tank
4 guide channel
5 inductor
6 supplementary coil
7 position measuring device
7' position measuring device
7" position measuring device
8 current measuring device
9 current measuring device
10 automatic control device
11 center plane
s position of the metal strand in the guide channel
s' position of the metal strand in the guide channel
s" position of the metal strand in the guide channel
$I_{Ind}$ induced current in the inductor
$I_{Korr}$ induced current in the supplementary coil
R direction of conveyance

The invention claimed is:

1. Device for hot dip coating a metal strand (1), in which the metal strand (1) is passed vertically through a coating tank (3) that contains the molten coating metal (2) and through a guide channel (4) upstream of the coating tank, with at least two inductors (5) installed on both sides of the metal strand (1) in the area of the guide channel (4) for generating an electromagnetic field in order to keep the molten coating metal (2) in the coating tank (3), and with at least two supplementary coils (6) installed on both sides of the metal strand (1) for generating an electromagnetic field superposed on the electromagnetic field of the inductors (5) in order to stabilize the metal strand (1) in a central position in the guide channel (4), comprising measuring devices (7, 7', 7", 8, 9) for measuring the position (s, s', s") of the metal strand (12) in the guide channel (4), the induced current ($I_{Ind}$) in the inductors (5), and the induced current ($_{Korr}$) in the supplementary coils (6) and by automatic control devices (10) that are suitable for controlling the induced current ($I_{Korr}$) in the supplementary coils (6) as a function of the measured parameters (s, s', s", $I_{Ind}$, $I_{Korr}$) in order to keep the metal strand (1) in a central position in the guide channel (4), such that the supplementary coils (6) are installed within the extent of the inductors (5), as viewed in the direction of conveyance (R) of the metal strand (1).

2. Device in accordance with claim 1, wherein at least one of the measuring devices (7, 7', 7") for determining the position (s, s', s") of the metal strand (1) in the guide channel (4) is an inductive pickup.

3. Device in accordance with claim 1, wherein at least one of the measuring devices (7, 7', 7") for determining the position (s, s', s") of the metal strand (1) in the guide channel (4) is installed within the extent of the inductors (5), as viewed in the direction of conveyance (R) of the metal strand (1).

4. Device in accordance with claim 1, wherein at least one of the measuring devices (7, 7', 7") for determining the position (s, s', s") of the metal strand (1) in the guide channel (4) is installed outside the extent of the inductors (5), as viewed in the direction of conveyance (R) of the metal strand (1).

5. Device in accordance with claim 1, wherein at least one of the measuring devices (7, 7', 7") for determining the position (s, s', s") of the metal strand (1) in the guide channel (4) is installed outside the extent of the supplementary coils (6), as viewed in the direction of conveyance (R) of the metal strand (1).

6. Device in accordance with claim 1, wherein several measuring devices (7, 7', 7") for determining the position (s, s', s") of the metal strand (1) in the guide channel (4) are installed in various places relative to the direction of conveyance (R) of the metal strand (1).

* * * * *